US008223115B2

(12) United States Patent
Chung et al.

(10) Patent No.: US 8,223,115 B2
(45) Date of Patent: Jul. 17, 2012

(54) LIQUID CRYSTAL DISPLAY AND DRIVING METHOD THEREOF

(75) Inventors: Injae Chung, Gyeonggi-do (KR); Kiduk Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 753 days.

(21) Appl. No.: 12/314,868

(22) Filed: Dec. 18, 2008

(65) Prior Publication Data

US 2009/0303170 A1 Dec. 10, 2009

(30) Foreign Application Priority Data

Jun. 9, 2008 (KR) ..... 10-2008-0053794

(51) Int. Cl.
*G09G 3/36* (2006.01)

(52) U.S. Cl. ..... 345/102; 345/204; 345/589; 345/690; 345/691; 345/84; 362/97.2

(58) Field of Classification Search ..... 345/102, 345/589, 204, 690–691, 84; 362/97.1–97.3
See application file for complete search history.

(56) References Cited

U.S. PATENT DOCUMENTS

| | | | | |
|---|---|---|---|---|
| 5,812,149 | A | 9/1998 | Kawasaki et al. | |
| 6,903,716 | B2 * | 6/2005 | Kawabe et al. | 345/99 |
| 2004/0114396 | A1 * | 6/2004 | Kobayashi et al. | 362/561 |
| 2004/0257328 | A1 * | 12/2004 | Lim | 345/100 |
| 2005/0062681 | A1 | 3/2005 | Hanbo | |
| 2005/0195152 | A1 * | 9/2005 | Yang et al. | 345/102 |
| 2007/0097058 | A1 * | 5/2007 | Kim et al. | 345/98 |
| 2007/0171218 | A1 * | 7/2007 | Hong et al. | 345/211 |
| 2008/0079680 | A1 | 4/2008 | Fujita | |
| 2008/0297464 | A1 * | 12/2008 | Ito | 345/102 |
| 2009/0040173 | A1 * | 2/2009 | Ezaki et al. | 345/102 |

(Continued)

FOREIGN PATENT DOCUMENTS

CN 1345022 A 4/2002

(Continued)

OTHER PUBLICATIONS

Takata, Yoshiki, Jun. 28, 2007, WO/2007/072598, "Display Device, Receiver and Method of Drivng Display Device".*

*Primary Examiner* — Lun-Yi Lao
*Assistant Examiner* — Md Saiful A Siddiqui
(74) *Attorney, Agent, or Firm* — Morgan, Lewis & Bockius LLP

(57) ABSTRACT

The liquid crystal display device includes a plurality of gate lines and a plurality of data lines forming a matrix, a back light unit including a plurality of light source blocks capable of being driven separately, an image processing circuit to generate a movement judgment signal based on a digital video data to be displayed in an interior mode, a backlight controller to generate a light source driving control signal to control portions of the light source blocks corresponding to a moving image and portions of the light source blocks corresponding to a still image, separately, based on the movement judgment signal, and a backlight driving circuit including a plurality of light source drivers to turn on the portions of the light source blocks corresponding to a moving image and to turn off the portions of the light source blocks corresponding to a still image based on the light source driving control signal.

17 Claims, 9 Drawing Sheets

U.S. PATENT DOCUMENTS

| | | | | |
|---|---|---|---|---|
| 2010/0002009 | A1* | 1/2010 | Takata | 345/589 |

FOREIGN PATENT DOCUMENTS

| | | | |
|---|---|---|---|
| CN | 1637508 | A | 7/2005 |
| CN | 1941051 | A | 4/2007 |
| CN | 101154004 | A | 4/2008 |
| JP | 9-230827 | A | 9/1997 |
| JP | 11-202842 | A | 7/1999 |
| JP | 11-296127 | A | 10/1999 |
| JP | 2001-282212 | A | 10/2001 |
| JP | 2008-20712 | A | 1/2008 |
| JP | 2008-299145 | A | 12/2008 |
| JP | 2011-514981 | A | 5/2011 |

* cited by examiner

Panel off

BLU off

LIQUID CRYSTAL DISPLAY AND DRIVING METHOD THEREOF

This application claims the benefit of Korea Patent Application No. 10-2008-0053794 filed on Jun. 9, 2008, which is incorporated herein by reference.

BACKGROUND OF THE INVENTION

1. Field of the Invention

The present invention relates to a liquid crystal display device and a driving method of the liquid crystal display device for reducing the electric power consumption.

2. Discussion of the Related Art

A liquid crystal display device (or "LCD") represents video and/or picture image by controlling the light transmittance ratio of the liquid crystal layer using an electric field applied to the liquid crystal layer corresponding to the video signal. The liquid crystal display device is a flat panel display device having merits of small size, thin thickness and low electric power consumption. Therefore, it is used in portable computers such as notebook PC, office automation appliances, audio/video devices, and so on. An active matrix type liquid crystal display device has a switching element at each liquid crystal cell that controls the liquid crystal cell actively.

For the switching element used in the active matrix type LCD device, a thin film transistor (or "TFT"), as shown in FIG. 1, is typically used. With respect to FIG. 1, the active matrix type LCD supplies the digital video data to the data line (DL) after converting the digital video data into the analogue data voltage based on the gamma reference voltage. At the same time, it supplies the scan pulse to the gate line (GL) to charge the data voltage to the liquid crystal cell (Clc). To do this, the gate electrode of the TFT is connected to the gate line (GL), the source electrode is connected to the data line (DL), and the drain electrode of the TFT is connected to the pixel electrode of the liquid crystal cell (Clc) and one electrode of the storage capacitor (Cst1). The common voltage (Vcom) is supplied to the common electrode of the liquid crystal cell (Clc), the counter electrode of the pixel electrode. The storage capacitor (Cst1) charges the data voltage supplied from the data line (DL) when the TFT turns on to keep the voltage of the liquid crystal cell (Clc) constant. When the scan pulse is applied to the gate line (GL), the TFT turns on so that a channel is formed between the source electrode and the drain electrode to supply the voltage on the data line (DL) to the pixel electrode. At this time, the liquid crystal molecules of the liquid crystal cell (Clc) are re-arranged by the electric field formed between the pixel electrode and the common electrode so that the incident light is modulated.

As the LCD device is not a self-luminescent display device, it requires a light source such as the backlight unit. There are two types of backlight units for LCD device, i.e., the direct type and the edge type. For the edge type, the light source is disposed around the LCD panel and the light from the light source is guided to the front surface of the LCD panel using a transparent light guide. For the direct type, the light source is dispose on the rear surface of the LCD panel so that the light from the backlight source is directly radiated to the LCD panel. Compared with the edge type, the direct type can provide brighter luminescence by disposing more light sources. Further, the direct type has an advantage of a larger light irradiating surface. Therefore, for an LCD TV requiring a large size LCD panel, the direct type is generally used.

However, the direct type liquid crystal display device has the following drawbacks. First, the LCD device according to the related art has high electric power consumption at the backlight unit as the LCD panel becomes larger and has a higher resolution. Second, the issue of high power consumption remains even when a video image is displayed only in portions of the overall LCD panel. This is because the light sources included in the backlight unit are driven simultaneously according to the power supply regardless of the area in which video image is displayed. Therefore, even if a video image is displayed in only portions of the LCD panel, the electric power consumption for driving the LCD panel is substantially identical. For the large and high resolution LCD TV according to the related art, due to the high power consumption problem, when the LCD panel is not in a normal driving mode as shown in FIG. 2*a*, the back light unit (BLU) of the LCD panel is always off, thereby entering a black mode as shown in FIG. 2*b*. Therefore, electric power efficiency is not maximized when the LCD TV is operating in an interior mode, in which only portions of the LCD panel displays an image.

SUMMARY OF THE INVENTION

Accordingly, the present invention is directed to a liquid crystal display and driving method thereof that substantially obviate one or more problems due to limitations and disadvantages of the related art.

An object of the present invention is to provide a liquid crystal display device and a driving method of the LCD device in which a video image can be displayed only in portions of the LCD panel with low electric power consumption thereby maximizing the electric power efficiency when the interior mode is selected.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display (LCD) device includes a plurality of gate lines and a plurality of data lines forming a matrix, a back light unit including a plurality of light source blocks capable of being driven separately, an image processing circuit to generate a movement judgment signal based on a digital video data to be displayed in an interior mode, a backlight controller to generate a light source driving control signal to control portions of the light source blocks corresponding to a moving image and portions of the light source blocks corresponding to a still image, separately, based on the movement judgment signal, and a backlight driving circuit including a plurality of light source drivers to turn on the portions of the light source blocks corresponding to a moving image and to turn off the portions of the light source blocks corresponding to a still image based on the light source driving control signal.

In another aspect, the liquid crystal display device includes a plurality of gate lines and a plurality of data lines forming a matrix, a back light unit including a plurality of light source blocks capable of being driven separately, a backlight controller to generate a light source driving control signal to control the light source blocks, and a backlight driving unit including a plurality of light source drivers to turn on predetermined portions of the light source blocks and to turn off remaining portions of the light source blocks in an interior mode based on the light source driving control signal.

In another aspect, a method of driving a liquid crystal display panel including a back light unit with a plurality of light source blocks capable of being driven separately, includes the steps of generating a movement judgment signal based on a digital video data to be displayed in an interior mode, and generating a light source driving control signal to control portions of the light source blocks corresponding to a moving image and portions of the light source blocks corresponding to a still image, separately, based on the movement judgment signal.

In another aspect, the method of driving a liquid crystal display panel including a back light unit with a plurality of light source blocks capable of being driven separately, includes the steps of generating a light source driving control signal, and turning on predetermined portions of the light source blocks and turning off remaining portions of the light source blocks in an interior mode based on the light source driving control signal.

In another aspect, the liquid crystal display device includes a plurality of gate lines and a plurality of data lines forming a matrix, a back light unit including a plurality of light source blocks capable of being driven separately, and a backlight controlling unit to turn on the portions of the light source blocks corresponding to a moving image and to turn off the portions of the light source blocks corresponding to a still image in an interior mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to the embodiments of the present invention, examples of which are illustrated in the accompanying drawings. Wherever possible, like reference numbers will be used for like elements.

Figure 1:
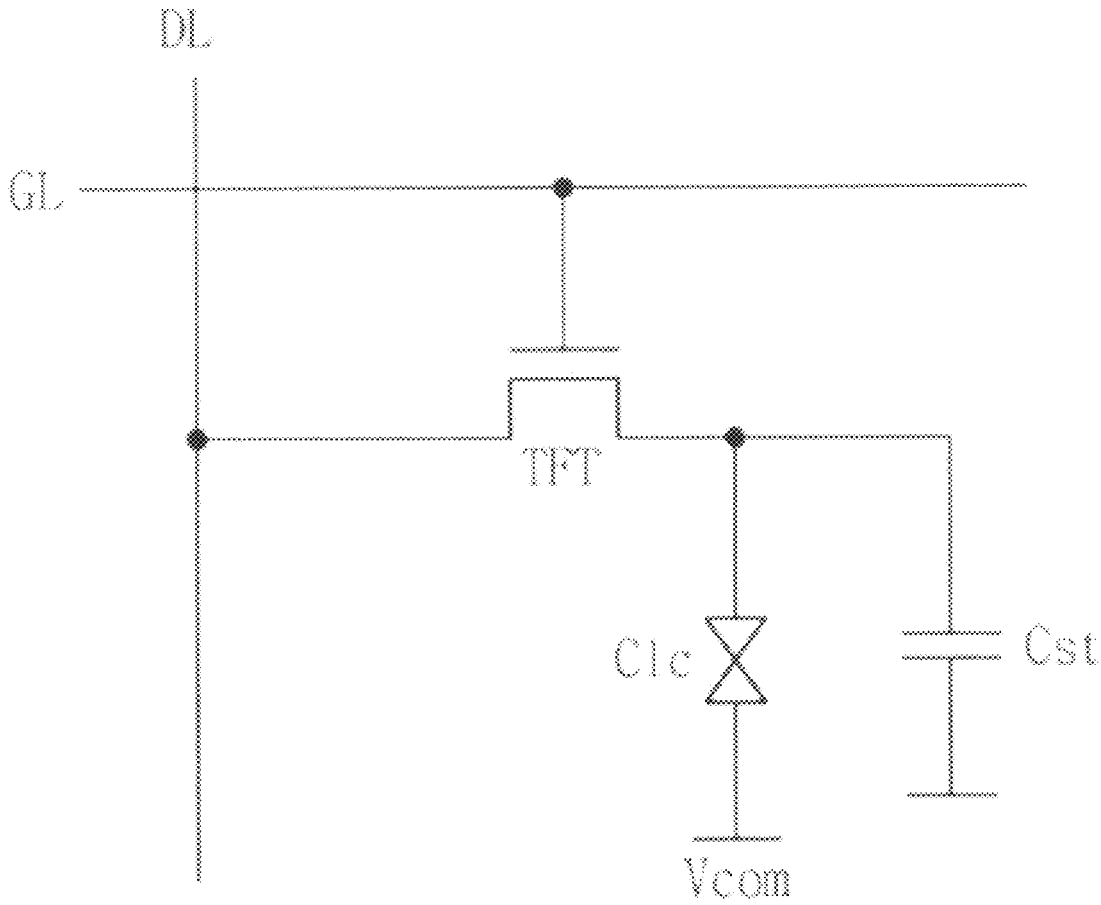
FIG. 1 (Related Art)
FIG. 1 is an equivalent circuit diagram illustrating a pixel according to the related art.
Figure 2A:
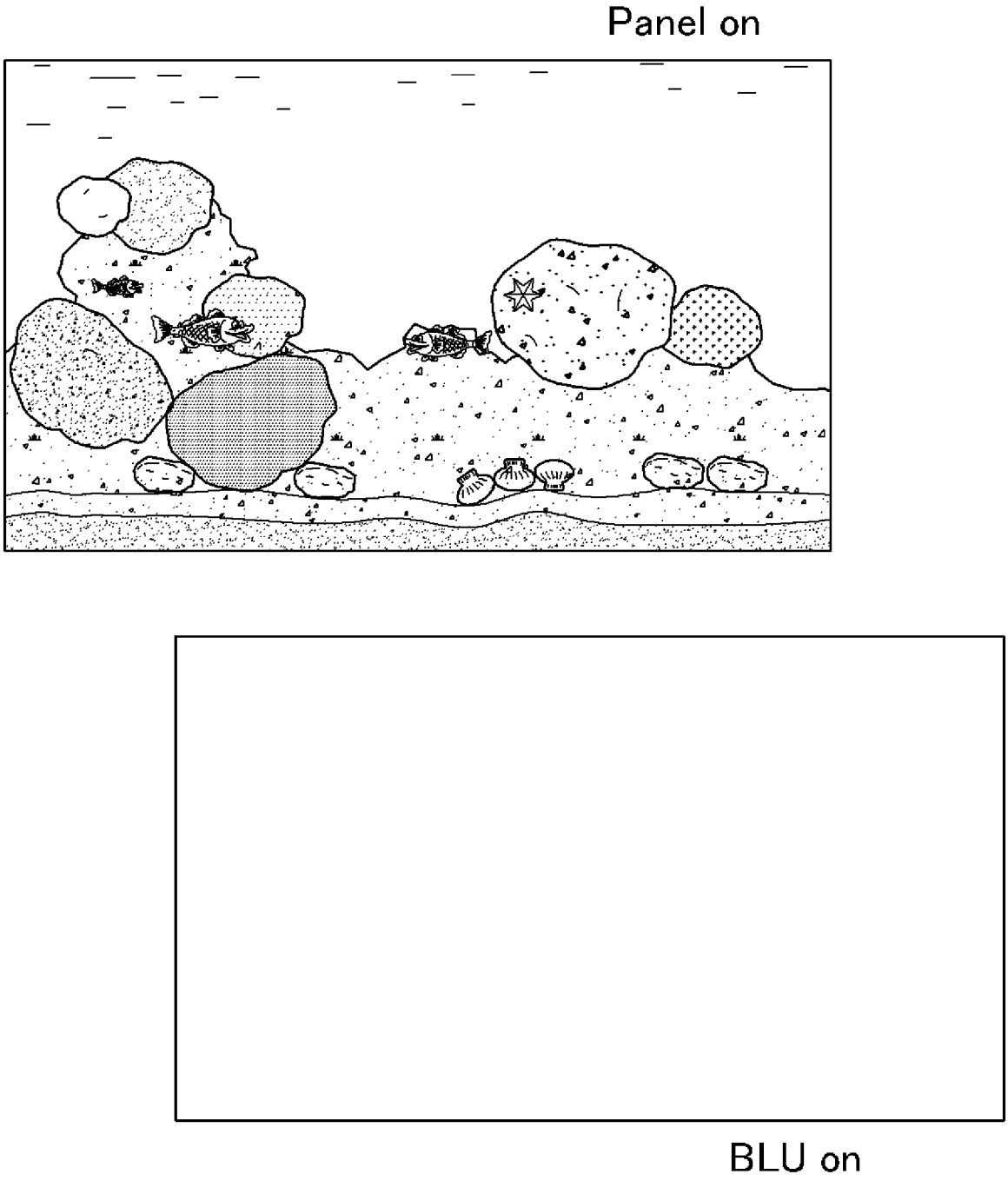
FIG. 2*a* is a diagram illustrating the normal driving mode in which image video is shown on the entire LCD panel according to the related art.
Figure 2B:
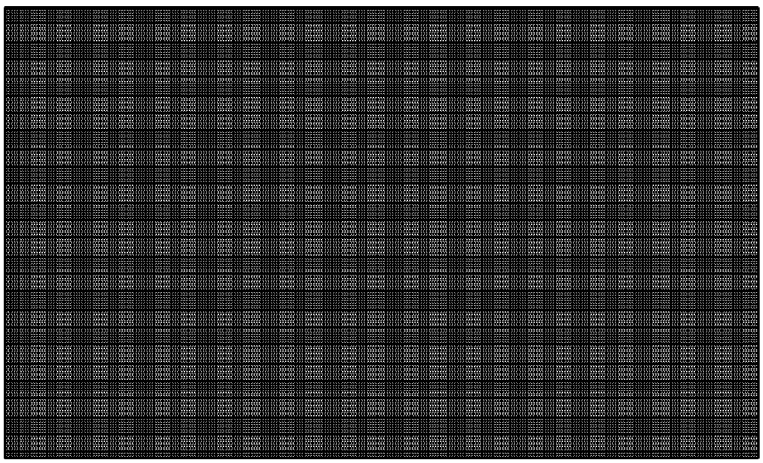
FIG. 2*b* is a diagram illustrating the black mode in which no image is displayed on the LCD panel according to the related art.
Figure 2B:
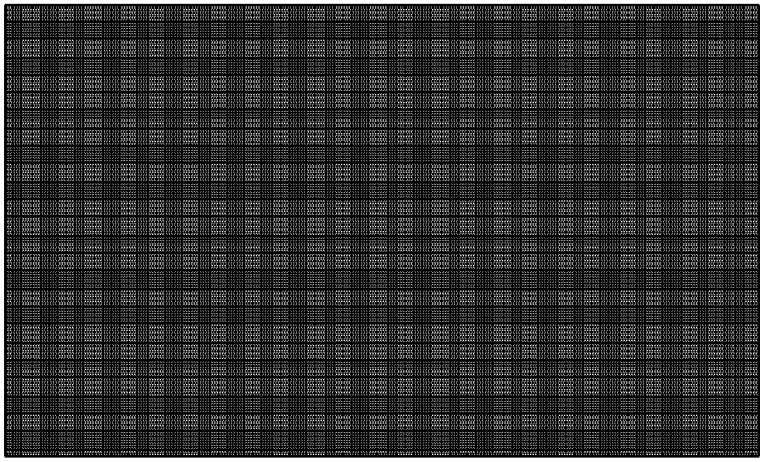
Figure 3:
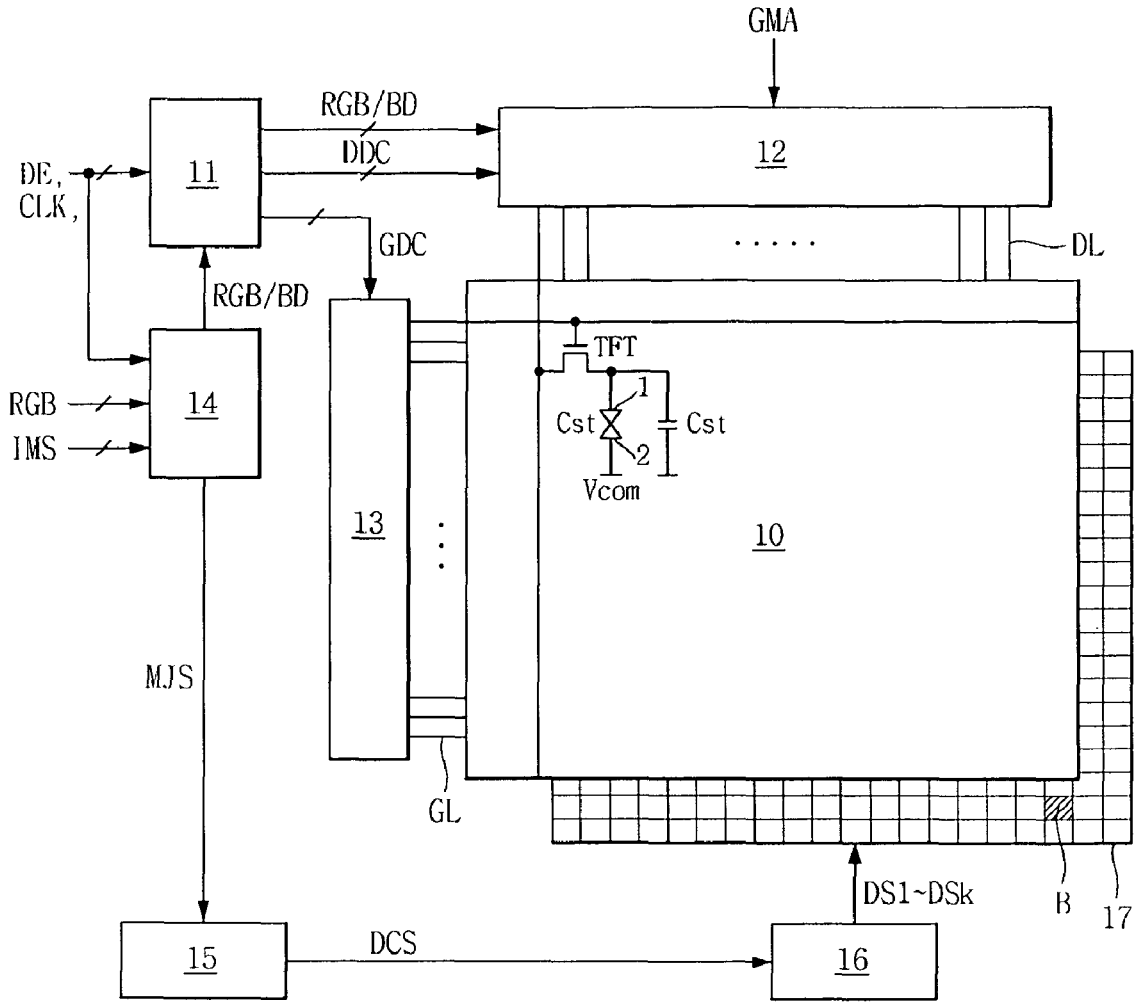
FIG. 3 is an exemplary block diagram illustrating the liquid crystal display device according to the first embodiment of the present invention.

FIGS. 3 to 7 illustrate the liquid crystal display device according to the first embodiment of the present invention. With respect to FIG. 3, the liquid crystal display device according to the first embodiment of the present invention comprises a liquid crystal display panel 10, a timing controller 11, a data driving circuit 12, a gate driving circuit 13, an image processing circuit 14, a backlight controller 15, a backlight driving circuit 16 and a backlight unit 17. Although FIG. 3 illustrates an exemplary embodiment wherein the image processing circuit, backlight controller, and the backlight driving circuit are separate circuits, they can be designed to be included in a single chip or circuit block, i.e., a backlight controlling unit.

The liquid crystal display panel 10 includes two glass substrates joining each other and a liquid crystal layer therebetween (not shown). The liquid crystal cells of the LCD panel 10 form an m×n matrix with 'm' data lines (DL) and 'n' gate lines (GL). On the lower glass substrate (not shown) of the liquid crystal display panel 10 are data lines (DL), gate lines (DL), TFTs, liquid crystal cells (Clc) connected to the TFTs and driven by the electric field between the pixel electrodes 1 and the common electrode 2, and storage capacitors (Cst). On the upper glass substrate (not shown) of the liquid crystal display panel 10, a black matrix (not shown), a color filter (not shown) and the common electrode 2 are formed.

In particular, the common electrode 2 is normally formed on the upper glass substrate in the vertical electric field driving type including TN mode (Twisted Nematic mode) and/or VA mode (Vertical Alignment mode). On the other hand, in the horizontal electric field driving type including IPS mode (In-Plane Switching mode) and/or FFS mode (Fringe Field Switching mode), the common electrode 2 is formed on the lower glass substrate with the pixel electrode 1. On the outer surfaces of the upper and lower glass substrates of the liquid crystal display panel 10, polarization plates (not shown) are attached. On the inner surface of the upper and lower glass substrate of the liquid crystal display panel 10, alignment layers (not shown) for setting the pre-tilt angle of the liquid crystal material are formed.

The timing controller 11 receives the timing signals such as the data enable (DE) signal and the dot clock (CLK) and then generates the control signals (GDC and DDC) for controlling the operating timing of the data driving circuit 12 and the gate driving circuit 13. The gate timing control signal (GDC) for controlling the operating timing of the gate driving circuit 13 includes the gate start pulse (GSP) indicating the start horizontal line from which the scan is starting during one vertical period of a screen, the gate shift clock (GSC) signal having a pulse width corresponding to the ON timing of the TFT, which is a timing control signal for sequentially shifting the gate start pulse (GSP) when entered into the shift register in the gate driving circuit 13, and the gate output enable (GOE) signal for indicating the output of the gate driving circuit 13.

The data timing control (DDC) signal for controlling the operating timing of the data driving circuit 12 includes the source sampling clock (SSC) indicating the latch operation in the data driving circuit 12 with reference to the rising or falling edge, the source output enable (SOE) signal for indicating the output of the data driving circuit 12, and the polarity control signal (POL) for indicating the polarity of the data voltage supplied to the liquid crystal cells (Clc) of the LCD panel 10. Further, the timing controller 11 rearranges the digital video data (RGB) and the black data (BD) input from the image processing circuit 14 to correspond to the resolution of the LCD panel 10, and then supplies them to the data driving circuit 12.

The data driving circuit 12 converts the digital video data (RGB) and the black data (BD) into the analogue gamma compensation voltage based on the gamma reference voltages (GMA) from the gamma reference voltage generator (not shown) in response to the data control signal (DDC), and then supplies the analogue gamma compensation voltage to the data lines (DL) of the LCD panel 10 as the data voltage. To do this, the data driving circuit 12 is equipped with a plurality of data drive ICs (not shown) including the shift register for sampling the clock signal, the register for temporarily storing the digital video data (RGB), and the latch for storing each line of data in response to the clock signal of the shift register and for outputting the stored line of data at the same time. The data driving circuit 12 also includes the digital/analogue converter for selecting the gamma voltage of either positive or negative polarity referring to the gamma reference voltage in correspondence to the digital data from the latch, the multiplexer for selecting the data line (DL) to be supplied with the analogue data converted by the positive/negative gamma voltage, and the output buffer connected between the multiplexer and data line (DL).

The gate driving circuit 13 sequentially supplies the scan pulse for selecting the horizontal line of the LCD panel 10 applied with the data voltage to the gate lines (GL). To do this, the gate driving circuit 13 is equipped with a plurality of gate drive IC including the shift register, the level shifter for converting the output signal of the shift register into the signal having proper swing width to drive the TFT of liquid crystal cell (Clc), and the output buffer connected between the level shifter and the gate lines (GL).

When the interior mode selection signal (IMS) is input from a user via the interface circuit (not shown), the image processing circuit 14 detects and/or generates the movement judgment signal (MJS) of the image at each region of the LCD panel 10 based on the digital video data (RGB) and the timing signal (DE and CLK) input from the system board (not shown). Based on the result, the image processing circuit 14 replaces the data shown on the region corresponding to a still image with a black data (BD). The image processing circuit 14 then supplies both the data (RGB) shown on the region for the moving picture and the replaced black data (BD) to the timing controller 11. In addition, the image processing circuit 14 supplies the movement judgment signal (MJS) of the image corresponding to each region to the backlight controller 15.

Figure 4:
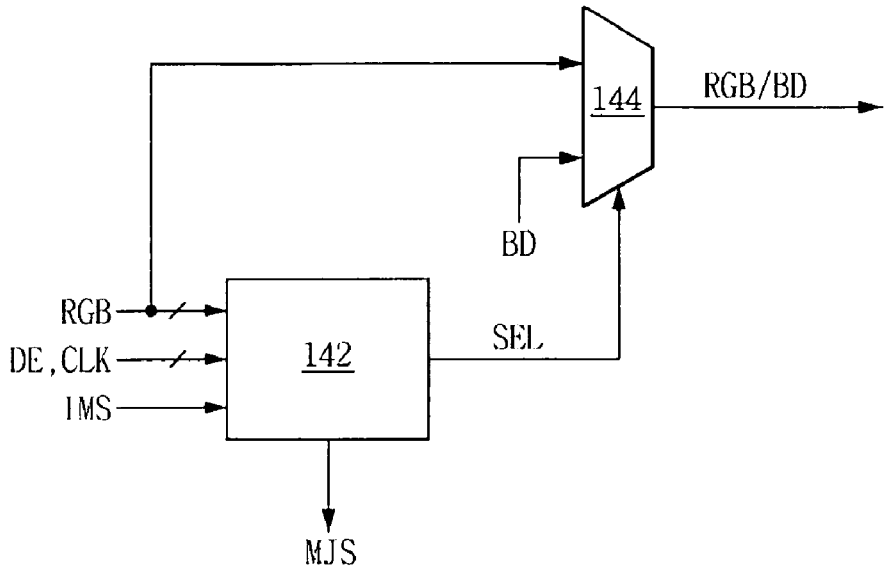
FIG. 4 is an exemplary block diagram illustrating the image processing circuit of FIG. 3.
Figure 5:
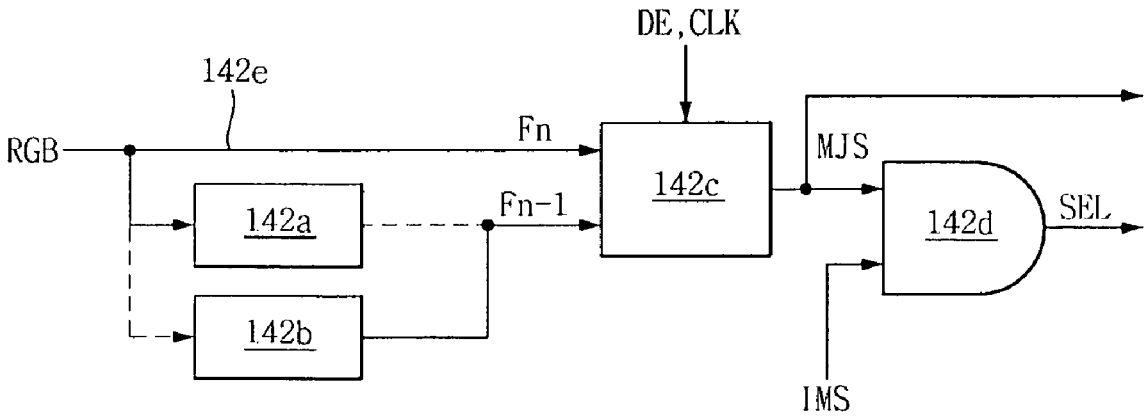
FIG. 5 is an exemplary block diagram illustrating the movement detector of FIG. 4.

As shown in FIG. 4, the image processing circuit 14 includes the movement detector 142 and the multiplexer 144. The image processing circuit 14 may be embedded into the timing controller 11. As shown in FIG. 5, the movement detector 142 includes the first and the second frame memories 142*a* and 142*b*, the comparator 142*c*, and the AND gate 142*d*.

The first and the second frame memories 142*a* and 142*b* store the digital video data (RGB) alternately in frame units according to the dot clock (CLK), and outputs the stored data (RGB) alternately to supply the previous data, that is the (n-1)$^{th}$ frame data (Fn-1), to the comparator 142*c*. The comparator 142*c* compares the n$^{th}$ frame data (Fn) provided from the data input bus line 142*e* with the (n-1)$^{th}$ frame data (Fn-1) provided from either the first or the second frame memories 142*a* or 142*b* based on the timing signals (DE and CLK). Based on the comparison result, the comparator 142*c* generates the movement judgment signal (MJS) of the image at each region of the LCD panel 10. In order to ensure the correctness of the detection, the comparator 142*c* may use the accumulated comparing value between frame data supplied consecutively. The movement judgment signal (MJS) of the image at each region has a different logic level (for example, '0' for moving picture, '1' for still picture, or vice versa) according to the condition for image, i.e., whether it is a moving picture or a still picture.

The AND gate 142*d* performs the logical multiplexing operation between the interior mode selection (IMS) signal from the user interface and the movement judgment signal (MJS) of the image at each region from the comparator 142*c* to generate the selection signal (SEL) for controlling the output of the multiplexer 144. The interior mode selection (IMS) signal generates different the logic levels according to the input condition through the user interface (not shown) (for example, '0' when signal is not received, and '1' when signal is received) and then enters into the AND gate 142*d*. Therefore, the selection signal (SEL) is at the first logic level (for example, '1') when the interior mode selection signal (IMS) is input and the image shown on region is the still image and otherwise, the selection signal (SEL) is at the second logic level (for example, '0').

The multiplexer 144 outputs the digital video data (RGB) and the black data (BD) selectively in response to the selection signal (SEL) from the movement detector 142, thereby replacing the data to be displayed in the region corresponding to the still image with the black data (BD). The multiplexer 144 further outputs the data (RGB) to be displayed in the region corresponding to the moving image together with this replaced black data (BD) to the timing controller 11. The multiplexer 144 replaces the data to be displayed in the region corresponding to the still image with the black data (BD) in response to the selection signal having the first logic level. In addition, the multiplexer 144 outputs the data to be displayed in the region corresponding to moving image as it is, in response to the selection signal having the second logic level. Here, the black data (BD) means the data having the substantially same gray-scale as the common voltage (Vcom) supplied to the LCD panel 10. The movement detector 142 shown in FIG. 5 is merely an exemplary embodiment and can employ other image detecting methods including the method using motion vectors.

The direct type backlight unit 17 includes the light source disposed at the rear side of the LCD panel 10, and irradiates light to the LCD panel 10. The light source may include a plurality of white LEDs which are desirable for a divisional driving method such as the local dimming method. Therefore, the backlight unit 17 is driven by being divided into unit light blocks (B) wherein each unit light block (B) includes at least one white LED and wherein each unit block is electrically connected to a different light source driver.

The backlight controller 15 generates the light source driving control signal (DCS) and supplies it to the backlight driving circuit 16. The DCS is the signal that turns on the light source blocks corresponding to the region representing the moving image, but turns off the light source blocks corresponding to the region corresponding to the still image, based on the movement judgment signal (MJS) of the image at each region which is output from the image processing circuit 14. To do this, the backlight controller 15 includes the position information of region for representing data (RGB/BD), the identity information of light source drivers for driving the light source blocks, and one-to-one mapping information between the position information and the identity information. The light source driving control signal (DCS) includes the dimming ratio, the value of which is controlled by the size of the region corresponding to the moving image in order to keep the electric power consumption at 10~20% of the electric power consumption in a normal mode with full dimming. The dimming ratio is controlled to have a lower value as the size of the region corresponding to the moving image increases. The back light controller 15 may be integrated into the control board (not shown) including the timing controller 11 or alternatively into an external system board (not shown).

Figure 6:
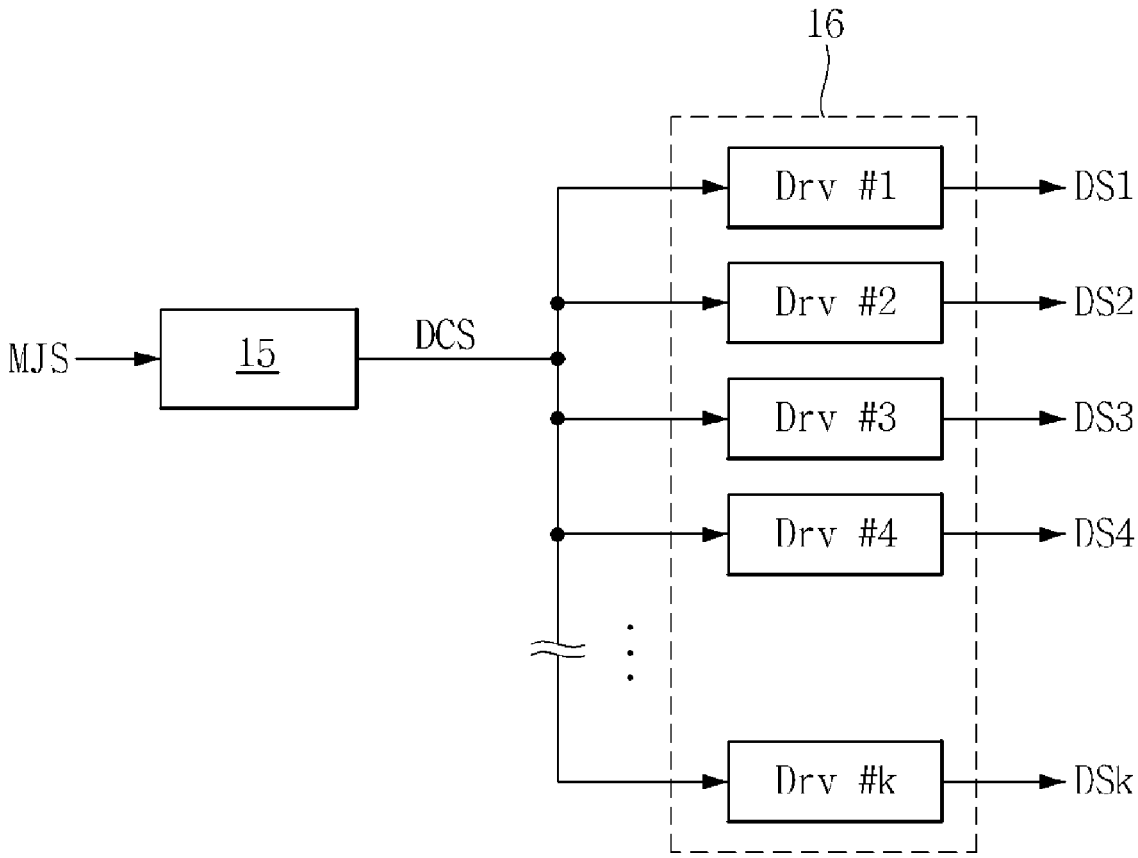
FIG. 6 is an exemplary diagram illustrating the relationship between the backlight controller and the backlight driving circuit.

As shown in FIG. 6, the backlight driving circuit 16 includes a plurality of light source drivers (Drv #1 to Drv #k). The backlight driving circuit 16 operates the light source drivers (Drv #1 to Drv #k) in response to the light source driving control signal (DCS) from the backlight controller 15. Therefore, the light source blocks corresponding to the region corresponding to the moving image will be turned on with a higher dimming ratio (compared to when there is no region corresponding to the still image), while the light source blocks corresponding to the region corresponding to the still image will be turn off.

Figure 7:
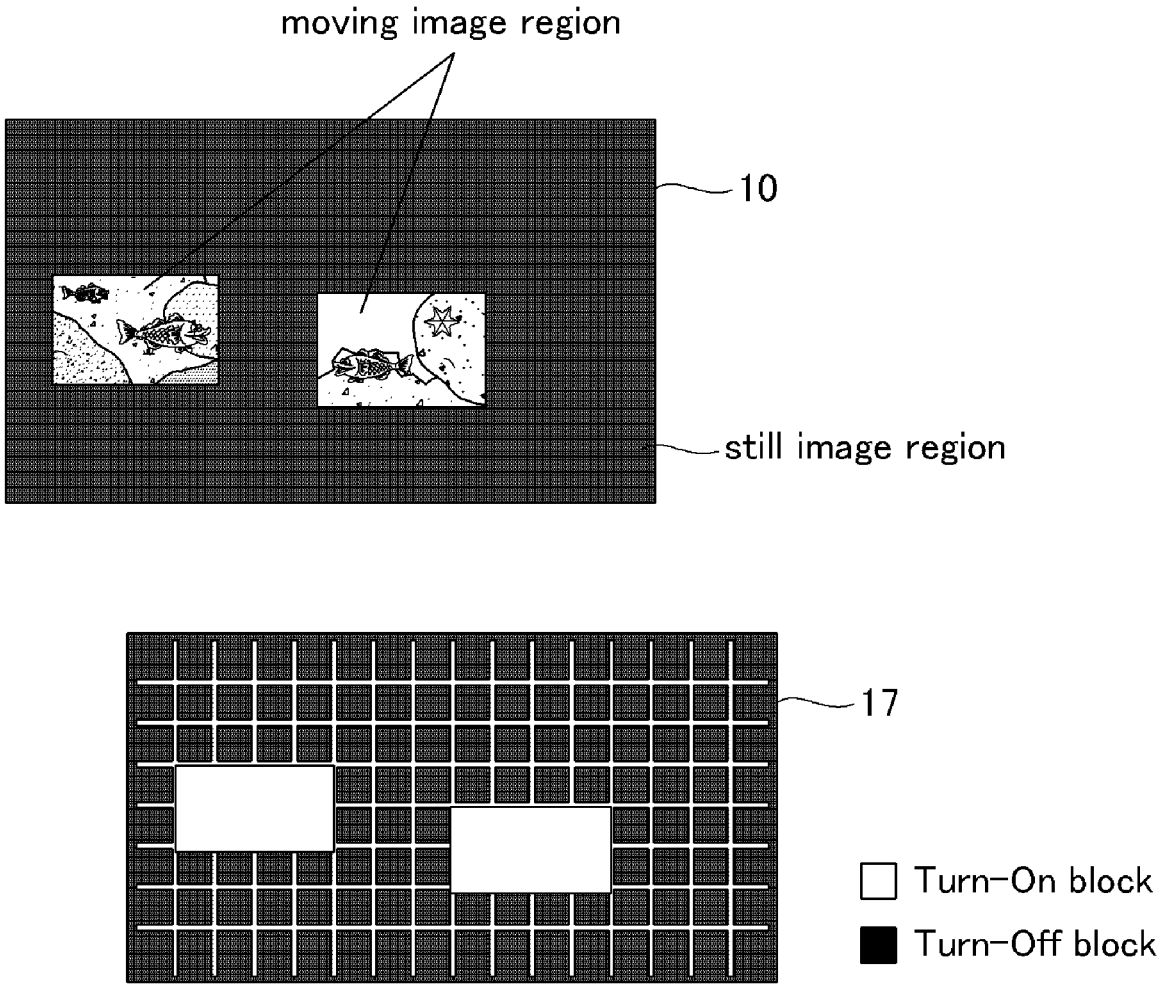
FIG. 7 is an exemplary diagram illustrating the image represented by the liquid crystal display device and the ON/OFF condition of the backlight unit when the interior mode selection signal is input.

FIG. 7 illustrates the image represented by the driving method and the turn-on and turn-off conditions of the backlight unit when the interior mode selection signal (IMS) is input, according to the first embodiment of the present invention.

With respect to the FIG. 7, in the liquid crystal display device according to the first embodiment of the present invention, the input digital video data (RGB) is displayed at the region corresponding to the moving image in the LCD panel 10 by turning on the light source blocks of the backlight unit 17 corresponding to the region corresponding to the moving image. On the other hand, the black data (BD) is displayed at the region corresponding to the still image because the light source blocks of the backlight unit 17 corresponding to the region corresponding to the still image are turned off. Therefore, the liquid crystal display device according to the first embodiment of the present invention is capable of displaying the image partially on the LCD panel with low electric power consumption. In the normal driving mode in which the interior mode selection signal (IMS) is not input, the liquid crystal display device according to the first embodiment of the present invention supplies the input digital video data as is to the LCD panel and turns on all the light source blocks of the backlight unit with full dimming ratio.

Figure 8:
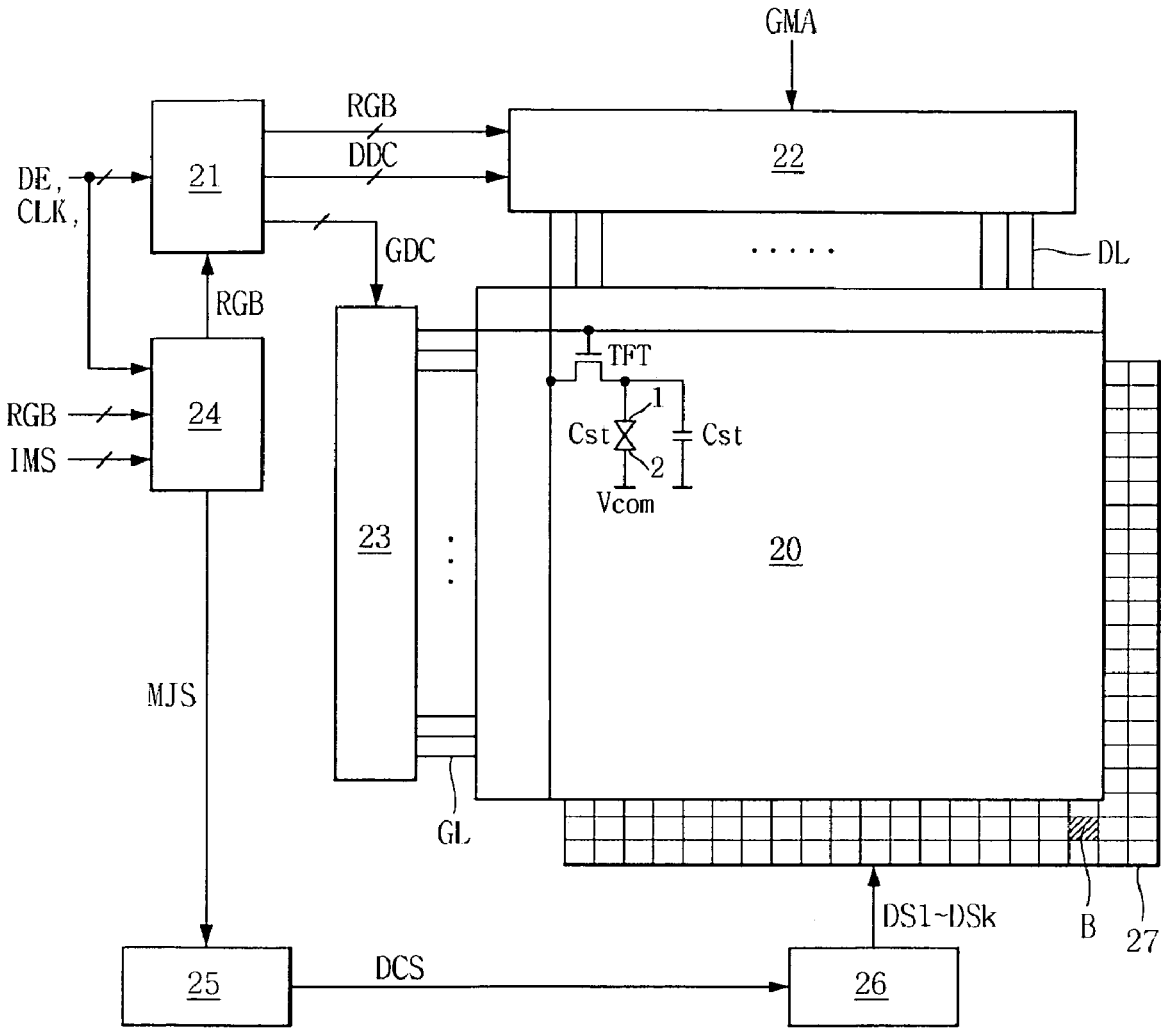
FIG. 8 is an exemplary block diagram illustrating the liquid crystal display device according to the second embodiment of the present invention.

FIG. 8 illustrates the liquid crystal display device according to the second embodiment of the present invention. With respect to FIG. 8, the liquid crystal display device according to the second embodiment of the present invention includes a liquid crystal display panel 20, a timing controller 21, a data driving circuit 22, a gate driving circuit 23, a image processing circuit 24, a back light controller 25, a back light driving circuit 26, and a back light unit 27. Although FIG. 8 illustrates an exemplary embodiment wherein the image processing circuit, backlight controller, and the backlight driving circuit are separate circuits, they can be designed to be included in a single chip or circuit block, i.e., a backlight controlling unit.

The liquid crystal display panel 20, the gate driving circuit 23, the back light controller 25, the back light driving circuit 26, and the back light unit 27 are substantially identical to the liquid crystal display panel 10, the gate driving circuit 13, the back light controller 15, the back light driving circuit 16, and the back light unit 17 of the first embodiment of the present invention, respectively. Accordingly, explanation thereto will be omitted. In addition, except for supplying the black data to the LCD panel 20, the timing controller 21 and the data driving circuit 22 have substantially the same function and operation as the timing controller 11 and the data driving circuit 12 shown in FIG. 3. Accordingly, explanation thereto will be omitted.

When the interior mode selection signal (IMS) is input through the user interface, the image processing circuit 24 generates a movement judgment signal (MJS) of the image at each region of the LCD panel 20 based on the digital video data (RGB) and the timing signals (DE and CLK) input from the system board (not shown). The image processing circuit 24 supplies the movement judgment signal (MJS) of the image for each region to the backlight controller 25. Unlike the image processing circuit 14 shown in FIG. 3, the image processing circuit 24 does not replace the data shown on the region corresponding to still image with the black data (BD). In other words, the image processing circuit 24 supplies the digital video data (RGB) to the timing controller 21 regardless of the movement judgment signal (MJS) of the image at each region.

In the liquid crystal display device according to the second embodiment of the present invention, the light source blocks of the backlight unit 27 corresponding to the region of the moving image with higher dimming ratio (compared to when there is no region corresponding to the still image) is turned on in response to the light source driving control signal (DCS), and the light source blocks of the backlight unit 27 corresponding to the region of the still image is turned off. Here, the liquid crystal display device according to the second embodiment of the present invention applies the input digital video data (RGB) as is to the LCD panel 20 even when the interior mode selection signal (IMS) is input. According to the second embodiment of the present invention, the liquid crystal display device can display the images partially on the liquid crystal display panel. Furthermore, the quality of the displayed image can be maintained even with poor light blocking between light source blocks.

On the other hand, the liquid crystal display device according to the second embodiment of the present invention turns on all light source blocks of the backlight unit 27 with a full dimming ratio in a normal driving mode, in which the interior mode selection signal (IMS) is not input.

Figure 9:
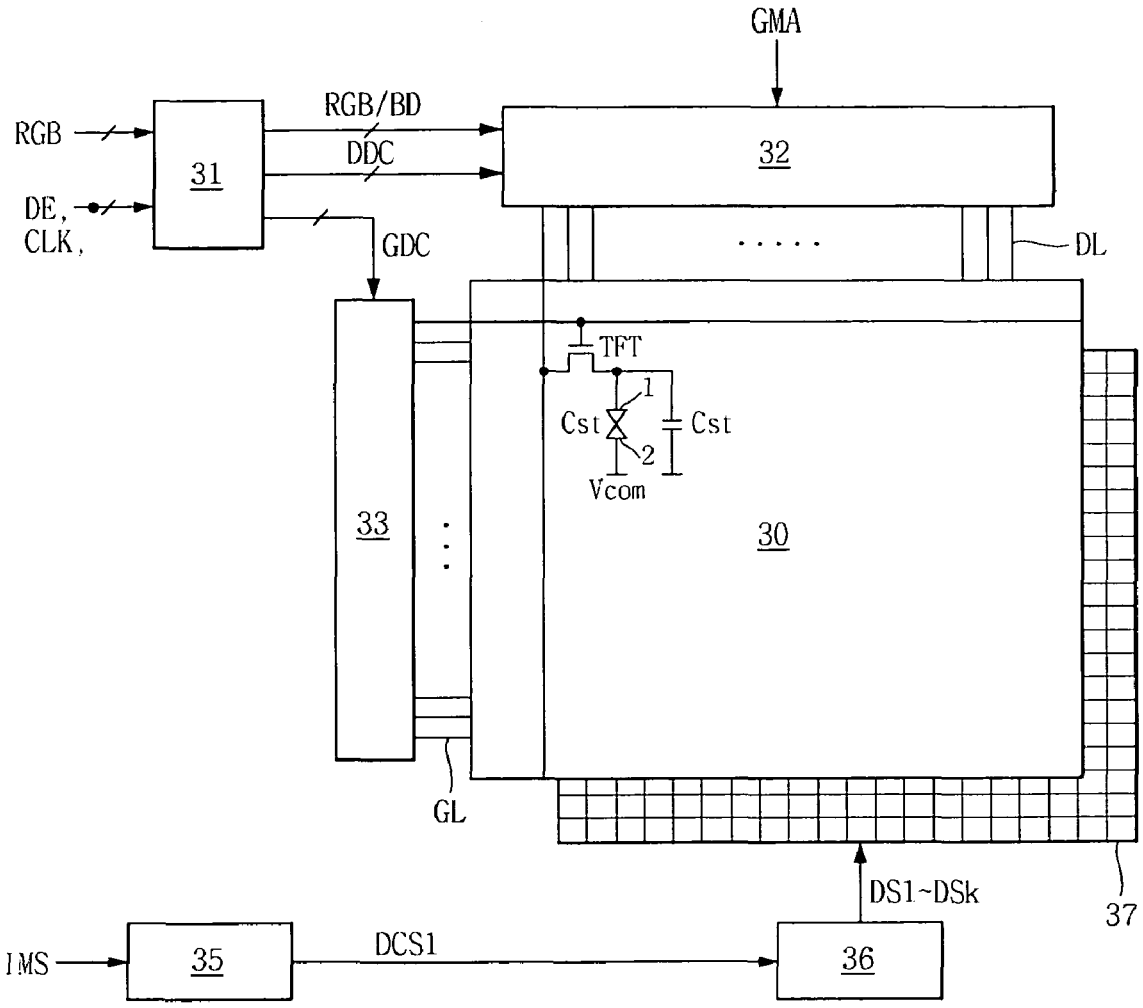
FIG. 9 is an exemplary block diagram illustrating the liquid crystal display device according to the third embodiment of the present invention.

FIG. 9 illustrates the liquid crystal display device according to the third embodiment of the present invention. With respect to FIG. 9, the liquid crystal display device according to the third embodiment of the present invention includes a liquid crystal display panel 30, a timing controller 31, a data driving circuit 32, a gate driving circuit 33, a back light controller 35, a back light driving circuit 36, and a back light unit 37. Although FIG. 9 illustrates an exemplary embodiment wherein the image processing circuit, backlight controller, and the backlight driving circuit are separate circuits, they can be designed to be included in a single chip or circuit block, i.e., a backlight controlling unit.

The liquid crystal display panel 30, the gate driving circuit 33, and the back light unit 37 are substantially the same as the liquid crystal display panel 10, the gate driving circuit 13, and the back light unit 17, respectively. Accordingly, explanation thereto will be omitted. In addition, except for supplying the black data to the LCD panel 30, the timing controller 31 and the data driving circuit 32 have substantially the same function and operation as the timing controller 11 and the data driving circuit 12 shown in FIG. 3. Accordingly, explanation thereto will be omitted.

When the interior mode selection signal (IMS) is input through the user interface (not shown) into the back light controller 35, the back light controller 35 generates a light source driving control signal (DCS1) to turn on light source blocks corresponding to a predetermined region having a predetermined size according to a predetermined sequence with a predetermined time interval. The predetermined sequence may be in a horizontal, vertical, diagonal, and/or circular directions, which one or ordinary skill in the art may use in screen savers. The light source driving control signal (DCS1) includes a dimming ratio corresponding to the size of the predetermined region which is turned on. The dimming ratio is set to be a lower value as the size of the predetermined region increases, in order to keep the electric power consumption to be substantially constant, e.g., 10~20% of the total electric power consumption in a normal mode with full dimming.

For example, assume that the total number of light source block is 100 and the desired electric power consumption can be met by using a dimming ration of 10%. If the predetermined region has 10-light source blocks, then the dimming ratio can be 100% without exceeding the desired level of electric power consumption. If the predetermined region has 50-light source blocks, then the dimming ratio can be 20% without exceeding the desired level of electric power consumption. And, if the predetermined region has 100-light source blocks, then the dimming ratio can only be 10% without exceeding the desired level of electric power consumption. The back light controller 35 can be intergrated into the control board (not shown) having a timing controller 31, or into an external system board (not shown).

The back light driving circuit 36 includes a plurality of light source drivers (Drv #1 to Drv #k), as shown in FIG. 6. The backlight driving circuit 36 operates the light source drivers (Drv #1 to Drv #k) in response to the light source driving control signal (DCS1) from the backlight controller 35. The light source blocks can be driven with 10 to 20% of the electric power consumption in a normal mode with full dimming. As a result, the liquid crystal display device according to the third embodiment of the present invention can display the image partially on the LCD panel with low electric power consumption. On the other hand, the liquid crystal display device according to the third embodiment of the present invention turns on the light source blocks of the backlight unit 37 with a full dimming ratio in the normal driving mode, in which the interior mode selection signal (IMS) is not input.

As mentioned above, in an interior mode, the liquid crystal display device and the driving method of the LCD device according to the present invention can turn on only the light source blocks of the backlight unit corresponding to the region of the moving image and turn off the light source blocks corresponding to the region of the still image. Therefore, in the interior mode, an image can be displayed with low power consumption, for example, only 10 to 20% of the electric power consumption in a normal mode with full dimming.

Furthermore, in an interior mode, the liquid crystal display device and the driving method for the LCD device according to the present invention can turn on light source blocks of the backlight unit corresponding to a predetermined region that changes sequentially in a predetermined order with a predetermined time interval and turn off light source blocks not corresponding to the predetermined region. Therefore, in the interior mode, an image can be displayed with low power consumption, for example, only 10 to 20% of the electric power consumption in a normal mode with full dimming.

It will be apparent to those skilled in the art that various modifications and variations can be made in the liquid crystal display and driving method thereof of the present invention without departing form the spirit or scope of the invention. Thus, it is intended that the present invention cover the modifications and variations of this invention provided they come within the scope of the appended claims and their equivalents.

What is claimed is:

1. A liquid crystal display (LCD) device, comprising:

a plurality of gate lines and a plurality of data lines forming a matrix;

a back light unit including a plurality of light source blocks capable of being driven separately;

an image processing circuit to generate a movement judgment signal based on a digital video data to be displayed in an interior mode;

a backlight controller to generate a light source driving control signal to control portions of the light source blocks corresponding to a moving image and portions of the light source blocks corresponding to a still image, separately, based on the movement judgment signal; and a backlight driving circuit including a plurality of light source drivers to turn on the portions of the light source blocks corresponding to a moving image and to turn off the portions of the light source blocks corresponding to a still image based on the light source driving control signal, wherein the moving image and the still image are included in a same frame, wherein:

the image processing circuit comprises a movement detector to detect movement of two consecutive frames of digital video data and to generate the movement judgment signal;

the movement judgment signal has a first logic level for the moving image and a second logic level different from the first logic level for the still image, and a multiplexer to output the digital video data as is for portions of the digital video data corresponding to the moving image and outputting black data for portions of the digital video data corresponding to the still image based on the movement judgment signal, wherein the movement detector includes:

first and second frame memories to store two consecutive frames of digital video data, respectively, and a comparator to compare the two consecutive frames stored in the first and second frame memories and to generate the movement judgment signal, and wherein the movement detector further includes a logic gate that is connected to the comparator to generate a selection signal for controlling the multiplexer to selectively output the digital video data and the black data.

2. The liquid crystal display (LCD) device according to claim 1, wherein the light source blocks include LEDs.

3. The liquid crystal display (LCD) device according to claim 1, wherein the image processing circuit outputs a black data in portions of the digital video data corresponding to the still image based on the movement judgment signal.

4. The liquid crystal display (LCD) device according to claim 3, wherein the image processing circuit outputs portions of the digital video data corresponding to the moving image as is.

5. The liquid crystal display (LCD) device according to claim 1, wherein the image processing circuit outputs both the portions of the digital video data corresponding to the still image and portions of the digital video data corresponding to the moving image as is regardless of the movement judgment signal.

6. The liquid crystal display (LCD) device according to claim 1, wherein the portions of the light source blocks are shifted in a predetermined sequence with a predetermined time interval.

7. The liquid crystal display (LCD) device according to claim 1, wherein a size of the portions of the light source blocks is 10 to 20% of the entire light source blocks.

8. The liquid crystal display (LCD) device according to claim 1, wherein the light source driving control signal includes a dimming ratio, which is determined such that total energy consumption in the interior mode is 10 to 20% of total energy consumption in a normal mode with full dimming.

9. A method of driving a liquid crystal display (LCD) panel including a back light unit with a plurality of light source blocks capable of being driven separately, the method comprising:

generating a movement judgment signal based on a digital video data to be displayed in an interior mode; and generating a light source driving control signal to control portions of the light source blocks corresponding to a moving image and portions of the light source blocks corresponding to a still image, separately, based on the movement judgment signal, wherein the moving image and the still image are included in a same frame, wherein:

a movement detector detects movement of two consecutive frames of digital video data and generates the movement judgment signal;

the movement judgment signal has a first logic level for the moving image, and a second logic level different from the first logic level for the still image, and a multiplexer outputs the digital video data as is for portions of the digital video data corresponding to the moving image, and outputs black data for portions of the digital video data corresponding to the still image based on the movement judgment signal, wherein the movement detector includes:

first and second frame memories which store two consecutive frames of digital video data, respectively, and a comparator which compares the two consecutive frames stored in the first and second frame memories and generates the movement judgment signal, and wherein the movement detector further includes a logic gate that is connected to the comparator and generates a selection signal for controlling the multiplexer to selectively output the digital video data and the black data.

10. The method according to claim 9, further comprising:

turning on the portions of the light source blocks corresponding to a moving image based on the light source driving control signal; and turning off the portions of the light source blocks corresponding to a still image based on the light source driving control signal.

11. The method according to claim 9, further comprising outputting a black data in portions of the digital video data corresponding to the still image based on the movement judgment signal.

12. The method according to claim 11, further comprising outputting portions of the digital video data corresponding to the moving image as is.

13. The method according to claim 9, further comprising outputting both the portions of the digital video data corresponding to the still image and portions of the digital video data corresponding to the moving image as is, regardless of the movement judgment signal.

14. The method according to claim 9, wherein the portions of the light source blocks are shifted in a predetermined sequence with a predetermined time interval.

15. The method according to claim 9, wherein a size of the predetermined portions is 10 to 20% of the entire light source blocks.

16. The method according to claim 9, wherein the light source driving control signal includes a dimming ratio which is determined such that total energy consumption in the interior mode is 10 to 20% of total energy consumption in a normal mode with full dimming.

17. A liquid crystal display (LCD) device, comprising:

a plurality of gate lines and a plurality of data lines forming a matrix;

a back light unit including a plurality of light source blocks capable of being driven separately; and a backlight controlling unit to turn on the portions of the light source blocks corresponding to a moving image and to turn off the portions of the light source blocks corresponding to a still image in an interior mode, wherein the moving image and the still image are included in a same frame, wherein:

a movement detector is configured to detect movement of two consecutive frames of digital video data and to generate a movement judgment signal;

the movement judgment signal has a first logic level for the moving image, and a second logic level different from the first logic level for the still image, and a multiplexer is configured to output the digital video data as is for portions of the digital video data corresponding to the moving image, and output black data for portions of the digital video data corresponding to the still image based on the movement judgment signal, wherein the movement detector includes:

first and second frame memories to store two consecutive frames of digital video data, respectively, and a comparator to compare the two consecutive frames stored in the first and second frame memories and to generate the movement judgment signal, and wherein the movement detector further includes a logic gate that is connected to the comparator to generate a selection signal for controlling the multiplexer to selectively output the digital video data and the black data.

* * * * *